US010467959B2

(12) United States Patent
Park et al.

(10) Patent No.: US 10,467,959 B2
(45) Date of Patent: Nov. 5, 2019

(54) ORGANIC LIGHT-EMITTING DISPLAY AND METHOD OF DRIVING SAME

(71) Applicant: LG DISPLAY CO., LTD., Seoul (KR)

(72) Inventors: JinWoo Park, Seoul (KR); Seokyu Jang, Goyang-si (KR); ChangBok Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 86 days.

(21) Appl. No.: 15/840,156

(22) Filed: Dec. 13, 2017

(65) Prior Publication Data

US 2019/0051239 A1 Feb. 14, 2019

(30) Foreign Application Priority Data

Aug. 9, 2017 (KR) ..... 10-2017-0101274

(51) Int. Cl.

*G09G 3/3233* (2016.01)
*G09G 3/3266* (2016.01)
*G09G 3/3275* (2016.01)
*G09G 3/3258* (2016.01)

(52) U.S. Cl.

CPC ..... *G09G 3/3233* (2013.01); *G09G 3/3258* (2013.01); *G09G 3/3266* (2013.01); *G09G 3/3275* (2013.01); *G09G 2300/0426* (2013.01); *G09G 2300/0819* (2013.01); *G09G 2300/0842* (2013.01); *G09G 2300/0861* (2013.01); *G09G 2310/08* (2013.01); *G09G 2320/0233* (2013.01); *G09G 2320/043* (2013.01); *G09G 2330/023* (2013.01); *G09G 2330/026* (2013.01); *G09G 2330/027* (2013.01)

(58) Field of Classification Search

CPC ..... G09G 3/3233; G09G 2320/043; G09G 2300/0819; G09G 2360/148; G09G 2320/045; G09G 2330/027; G09G 2330/026; G09G 2310/08; G09G 2330/02

See application file for complete search history.

(56) References Cited

U.S. PATENT DOCUMENTS 6,081,902 A * 6/2000 Cho ..... G06F 1/26 713/330
2012/0293562 A1* 11/2012 Park ..... G09G 3/3233 345/690
2013/0320886 A1* 12/2013 Seo ..... H05B 37/02 315/360
2014/0092144 A1* 4/2014 Kim ..... G09G 3/3233 345/690
2015/0187314 A1* 7/2015 Choi ..... G09G 3/3677 345/99

(Continued)

*Primary Examiner* — Sanjiv D. Patel
(74) *Attorney, Agent, or Firm* — Morgan, Lewis & Bockius LLP

(57) ABSTRACT

Disclosed is an organic light-emitting display device including: a display panel; a drive IC configured to supply a driving signal to the display panel; and a controller configured to operate in one of a first driving scheme, in which, when turned on, a sensing period of sensing characteristics of the display panel is executed, after which a display period of displaying an image on the display panel is executed, and a second driving scheme, in which, when turned on, the display period of displaying the image on the display panel is executed, the controller operating in the second driving scheme when turned on within a preset time after having been turned off.

15 Claims, 11 Drawing Sheets

(56) References Cited

U.S. PATENT DOCUMENTS

| | | | | |
|---|---|---|---|---|
| 2016/0117974 | A1* | 4/2016 | Back | G09G 3/3225 345/213 |
| 2016/0189630 | A1* | 6/2016 | Chang | G09G 3/3291 345/211 |
| 2018/0218689 | A1* | 8/2018 | Wang | G09G 3/3225 |
| 2018/0293016 | A1* | 10/2018 | Meng | G11C 7/20 |

* cited by examiner

ORGANIC LIGHT-EMITTING DISPLAY AND METHOD OF DRIVING SAME

CROSS REFERENCE TO RELATED APPLICATION

This application claims priority from Korean Patent Application No. 10-2017-0101274, filed Aug. 9, 2017, which is hereby incorporated by reference for all purposes as if fully set forth herein.

BACKGROUND

1. Technical Field

The present invention relates to an organic light-emitting display and a method of driving the same.

2. Description of the Related Art

With the advent of the information-oriented society, demand for display devices for displaying an image in various forms is increasing, and in recent years, various types of flat display devices, such as Liquid Crystal Displays (LCDs), plasma display devices, and Organic Light-Emitting Displays (OLEDs), have been utilized.

Among the flat display devices, organic light-emitting displays, which can be easily thinned and have an excellent viewing angle and contrast range, are widely used at present. The organic light-emitting display supplies driving current to an organic light-emitting diode, which is a self-light-emitting device, and emits light, so as to represent an image. However, if the organic light-emitting diode emits light for a long time, deterioration thereof may occur. Particularly, when a high-luminance still image is displayed, deterioration may more easily occur. An afterimage is formed in the organic light-emitting diode due to the deterioration, and thus the life expectancy thereof is shortened.

Further, a threshold voltage difference may be generated due to process deviation of driving transistors for supplying driving currents to organic light-emitting diodes; and, accordingly, a driving-current variation for each pixel may be generated. When such a driving-current variation is generated, the organic light-emitting display device may have a problem with image quality deviation. The driving-current variation is generated by deterioration of the driving transistor and/or the organic light-emitting diode, so the size thereof varies depending on a time of use.

Accordingly, the organic light-emitting display device should perform a compensation operation to compensate for image quality deviation in accordance with the time of use. To this end, the organic light-emitting display device should perform the compensation operation when turned on.

However, when a user turns on the organic light-emitting display again a very short time after having previously being turned on, it takes a long time to display an image on the organic light-emitting display device due to the performance of the compensation operation.

SUMMARY

Accordingly, embodiments of the present disclosure are directed to an organic light-emitting display and a method of driving the same that substantially obviate one or more of the problems due to limitations and disadvantages of the related art.

An aspect of the present embodiments is to provide an organic light-emitting display device and a method of driving the same, which can improve image quality.

Another aspect of the present embodiments is to provide an organic light-emitting display device that which can be rapidly turned on and a method of driving the same.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described, an organic light-emitting display device comprises a display panel; a drive circuit configured to supply a driving signal to the display panel; and a controller configured to operate in one of a first driving scheme, in which, when turned on, a sensing period of sensing characteristics of the display panel is executed and then a display period of displaying an image on the display panel is executed, and a second driving scheme, in which, when turned on, the display period of displaying the image on the display panel is executed, and operates in the second driving scheme when turned on within a preset time after being turned off.

In another aspect, an organic light-emitting display device comprises a display panel configured to receive pixel-driving power for operation thereof; a drive circuit configured to operate in accordance with IC-driving power and provide a data signal to the display panel; a controller configured to control the drive circuit and operate in accordance with the IC-driving power; and a power unit configured to supply the pixel-driving power and the IC-driving power and maintain the IC-driving power for a preset time after a turn-off signal is input.

In another aspect, a controller comprises a memory configured to store a characteristic value of a display panel and loaded in accordance with IC-driving power; and a compensation block configured to receive the display panel characteristic value from the memory to generate a compensation value when the memory is loaded, wherein the IC-driving power is maintained for a preset time after being turned off.

In another aspect, a method of driving an organic light-emitting display device comprises executing a sensing period of generating a compensation value corresponding to a characteristic of a display panel by a controller when a turn-on signal is detected; executing a display period of displaying an image by compensating for an image signal transmitted to the display panel in accordance with the compensation value by the controller; and re-executing the display period in accordance with the compensation value when a turn-on signal is detected within a preset time after being turned off.

According to the present embodiments, it is possible to provide an organic light-emitting display device and a method of driving the same, which can improve image quality.

According to the present embodiments, it is possible to provide an organic light-emitting display device that can be rapidly turned on and a method of driving the same.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated and constitute a part of this application, illustrate embodiments of the disclosure and together with the description serve to explain various principles. In the drawings.

DETAILED DESCRIPTION

Figure 1:
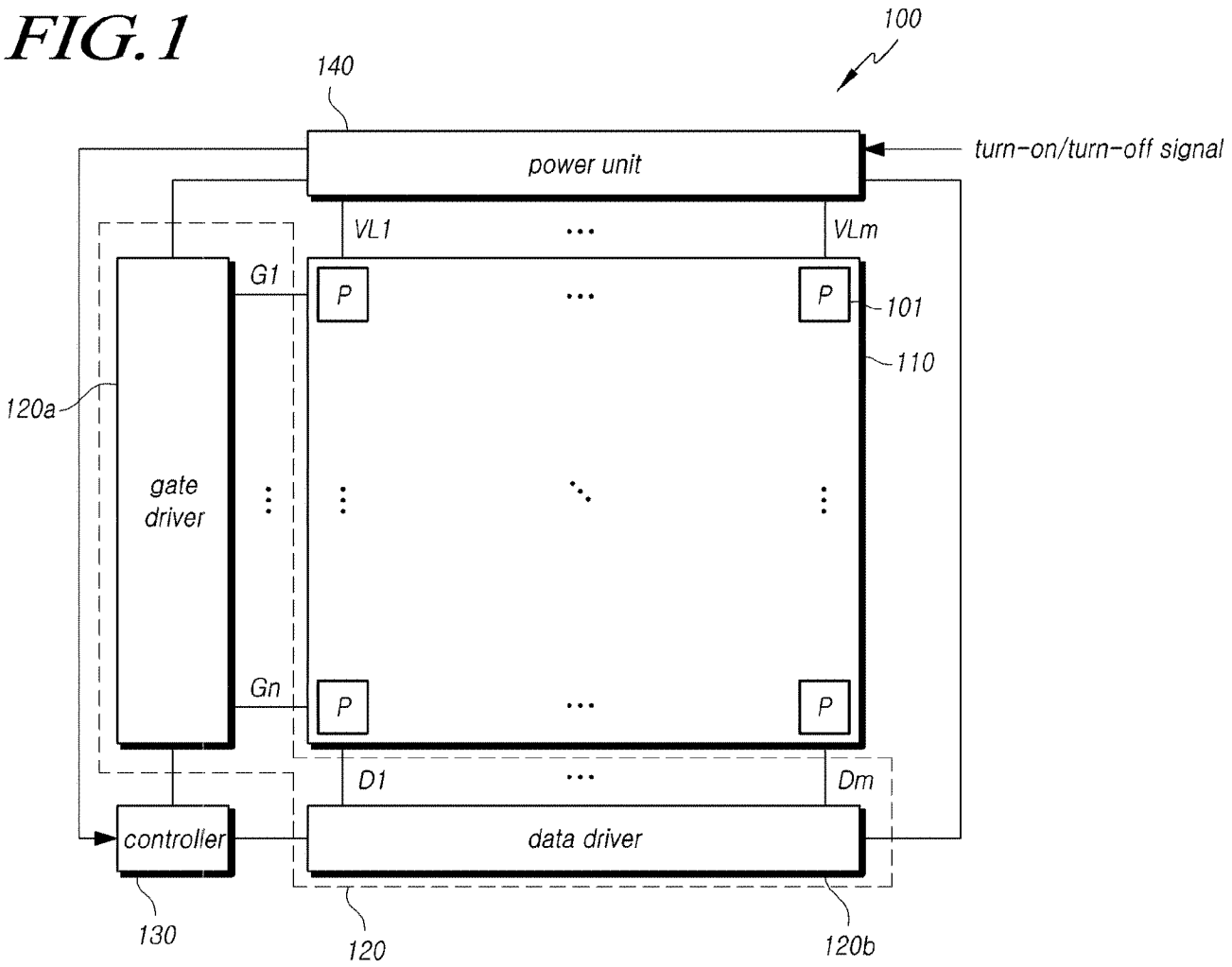
FIG. 1 illustrates the structure of an organic light-emitting display device according to the present embodiments.

Hereinafter, example embodiments of the present disclosure will be described in detail with reference to the accompanying illustrative drawings. In designating elements of the drawings by reference numerals, the same elements will be designated by the same reference numerals although they are shown in different drawings. Further, in the following description of the present invention, a detailed description of known functions and configurations incorporated herein will be omitted when it may make the subject matter of the present invention rather unclear.

In addition, terms, such as first, second, A, B, (a), (b) or the like may be used herein when describing components of the present invention. Each of these terminologies is not used to define an essence, order or sequence of a corresponding component but used merely to distinguish the corresponding component from other component(s). In the case that it is described that a certain structural element "is connected to", "is coupled to", or "is in contact with" another structural element, it should be interpreted that another structural element may "be connected to", "be coupled to", or "be in contact with" the structural elements as well as that the certain structural element is directly connected to or is in direct contact with another structural element.

FIG. 1 illustrates the structure of an organic light-emitting display device according to the present embodiments.

Referring to FIG. 1, an organic light-emitting display device 100 may include a display panel 110, a drive IC 120 for providing a data signal to the display panel 110, and a controller 130 for controlling the drive IC 120.

The display panel 110 may have a plurality of gate lines (G1, . . . , Gn) and a plurality of data lines (D1, . . . , Dm) that cross each other. Further, the display panel 110 may include a plurality of pixels 101 formed in a corresponding area in which the plurality of gate lines (G1, . . . , Gn) and the plurality of data lines (D1, . . . , Dm) cross each other. The plurality of pixels 101 may include organic light-emitting diodes (not shown) and a pixel circuit (not shown) for supplying driving currents to the organic light-emitting diodes. The pixel circuit may be connected to the gate lines (G1, . . . , Gn) and the data lines (D1, . . . , Dm) and may supply driving currents to the organic light-emitting diodes. Further, the display panel 110 may have power lines (VL1, . . . , VLm) for supplying a plurality of driving powers arranged thereon. The power lines (VL1, . . . , VLm) may be arranged parallel to the data lines (D1, . . . , Dm). However, the present invention is not limited thereto.

The drive IC 120 may be connected to the plurality of gate lines (G1, . . . , Gn) to supply gate signals, and may be connected to the plurality of data lines (D1, . . . , Dm) to supply data signals. To this end, the number of drive ICs 120 may be plural, and each of the drive ICs 120 may include a gate driver 120*a* and a data driver 120*b*. Although it is illustrated that the gate driver 120*a* is arranged on the left side of the display panel 110 as a separate element, the gate driver 120*a* may be arranged on each of the left side and the right side of the display panel 110. However, the arrangement of the gate driver 120 is not limited thereto. The number of drive ICs 120 may be plural. Further, a plurality of drive ICs may be referred to as a drive circuit.

Further, the gate driver 120*a* may be formed on the display panel 110 and may include a Gate-In-Panel (GIP) circuit connected to the gate lines (G1, . . . , Gn). The data driver 120*b* may receive an image signal and generate a data signal. Although only one data driver 120*b* is illustrated, the present invention is not limited thereto, and the number of data drivers 120*b* may be plural depending on the size and resolution of the display panel 110. The drive IC 120 may be connected to the display panel 110 through a Flexible Printed Circuit Board (FPCB).

When the user turns on the organic light-emitting display device 100, the drive IC 120 may operate by receiving first driving power. Further, the drive IC 120 may receive an image signal (RGB) from the controller 130 and generate a data signal. The drive IC 120 may receive a sensing signal from the controller 130, supply the sensing signal to the display panel 110, and receive panel information. The drive IC 120 may operate with a display period of supplying the image signal and a sensing period of supplying the sensing signal. The panel information may include information about deterioration of the driving transistor from each pixel of the display panel 110 and information about deterioration of the organic light-emitting diode. However, the present invention is not limited thereto. As the drive IC 120 supplies sensing data to each pixel 101 of the display panel 110 and acquires information about deterioration of the driving transistor and information about deterioration of the organic light-emitting diode in accordance with the sensing data, the controller 130 may receive panel information.

The controller 130 may supply a control signal to the drive IC 120. Further, the controller 130 may supply the image signal and the sensing signal to the drive IC 120. The image signal supplied to the drive IC 120 may be an image signal compensated for by the controller 130 according to the characteristics of the display panel 110. The sensing signal may correspond to a characteristic value of the display panel 110 recorded in a memory (not shown). The characteristic value of the display panel 110 may include an initial characteristic value and a normal characteristic value. The initial characteristic value may be information acquired by applying a signal to the display panel 110 when the display panel 110 is manufactured. The normal characteristic value may be a compensation value acquired by applying the sensing signal to the display panel 110. In the following description, the term "characteristic value" refers to the normal characteristic value unless particularly mentioned otherwise. Further, the controller 130 may generate a compensated image signal based on panel information supplied from the drive IC 120. The controller 130 may be a timing controller. However, the present invention is not limited thereto.

When the user turns on the organic light-emitting display device 100, the controller 130 may receive second driving power, and when the user turns off the organic light-emitting display device 100, may not receive second driving power. Further, when the user turns off the organic light-emitting display device 100, the controller 130 may receive second driving power for a predetermined time after being turned off. That is, even though the organic light-emitting display device 100 is turned off, the second driving power may be maintained for a predetermined time. The controller 130 may control the drive IC 120 to execute the sensing period of receiving panel information from the drive IC 120 according to the initial characteristic value of the display panel 110 in response to the turn-on signal. The controller 130 may determine a compensation value based on the panel information received in the sensing period. Further, the controller 130 may control the drive IC 120 to execute the display period. In the display period, the controller 130 may generate a compensated image signal according to the determined compensation value and transmit the image signal to the display panel 110 based on the compensated image signal, so as to display the image on the display panel 110.

The driving of the controller 130 may stop in accordance with the supply of second driving power. Further, when the second driving power is supplied, the controller 130 may execute the sensing period and the display period. The organic light-emitting display device may deteriorate with use over time, and thus the panel information of the display panel 110 may change. Accordingly, when the organic light-emitting display device 100 is turned on, the organic light-emitting display device 100 may execute the sensing period to detect a degree of deterioration of the display panel 110 and generate panel information. Further, the controller 130 may prevent the quality of the image displayed on the display panel 110 during the display period from being degraded due to the deterioration by compensating for the image signal according to the panel information generated during the sensing period.

However, if the display period is executed after the sensing period is executed after the turning on, the image may be displayed on the display panel 110 only when the sensing period has passed. Accordingly, the display panel 110 requires a time as much as the sensing period before the image is displayed. Therefore, when the user turns on the organic light-emitting display device 100, the image is not immediately displayed on the display panel 110. In particular, when the user turns off the organic light-emitting display device 100 by mistake, the display of an image on the display panel 110 may be delayed because of the re-execution of the sensing period even though the organic light-emitting display device 100 was just turned off.

Accordingly, the controller 130 may select one of a first driving scheme of executing the sensing period, in which a compensation value is generated according to a panel characteristic of the display panel 110 in response to a turn-on signal and then executing the display period, in which the image is displayed on the display panel 110 according to the compensation value, and a second driving scheme of executing the display period, in which, when the turn-on signal is input, the image is displayed on the display panel according to a pre-generated compensation value, and may operate through one selected from the first driving scheme and the second driving scheme as necessary. When the second driving scheme is selected, the controller 130 may directly execute the display period without separately executing the sensing period, thereby preventing the delay of the display of the image on the display panel 110.

According to an embodiment, when the turn-on signal is input within a preset time after the turn-off signal is input, the controller 130 may select the second driving scheme. Accordingly, when the turn-on signal is input within a preset time after the turn-off signal is input, the controller 130 may directly execute the display period without executing the sensing period, thereby preventing the display of the image on the display panel 110 from being delayed.

According to an embodiment, the organic light-emitting display device 100 may further include a power unit 140 for supplying driving power to the display panel 110, the drive IC 120, and the controller 130. Further, the power unit 140 may generate pixel-driving power transmitted to the display panel 110 and first driving power and second driving power transmitted to ICs. The first driving power may be transmitted to the drive IC 120, and the second driving power may be transmitted to the controller 130. However, the present invention is not limited thereto. Further, the power unit 140 may receive IC-driving power from an external device and generate first driving power and second driving power.

The power unit 140 may be driven according to a turn-on/turn-off signal. Further, even if the turn-off signal is input, the power unit 140 may maintain the supply of the second driving power for a preset time, so that the controller 130 may not be turned off within the preset time.

Accordingly, even if the turn-off signal is generated, the controller 130 may receive the second driving power from the power unit 140 for the preset time and driving thereof may not stop. When the driving thereof does not stop, the panel information stored in the controller 130 may be maintained. Accordingly, the controller 130 may use pre-generated panel information in spite of the input of the turn-off signal. For the same reason, when the turn-on signal is input again within a preset time after the turn-off signal is input, the controller 130 may use the maintained panel information. Accordingly, the controller 130 may generate a compensation image signal without executing the sensing period. When the turn-on signal is input again within the preset time after the turn-off signal is generated, the controller 130 may use the maintained panel information and thus may not require a separate sensing period. For the same reason, the controller 130 may directly execute the display period without executing the sensing period, thereby reducing the time during which no image is displayed on the display panel 110.

Figure 2A:
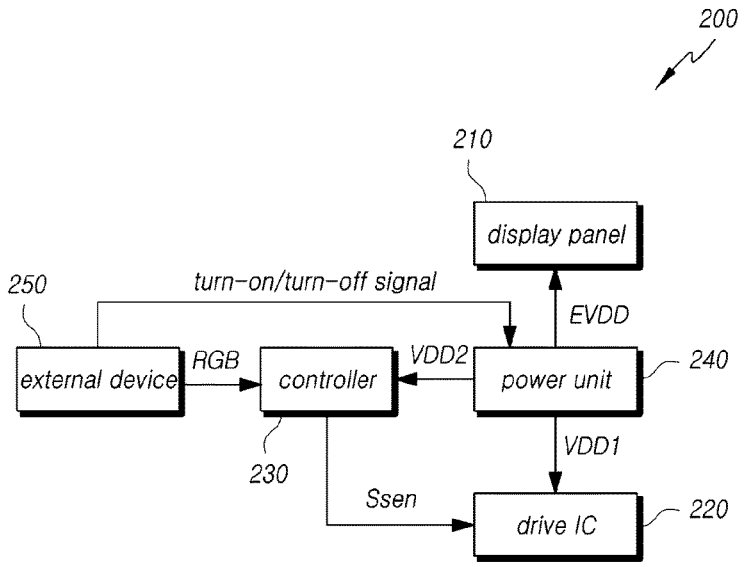
FIG. 2A is a block diagram illustrating an organic light-emitting display device according to the present embodiments.

FIG. 2A is a block diagram illustrating an organic light-emitting display device according to the present embodiments.

Referring to FIG. 2A, an organic light-emitting display device 200 may include a display panel 210 for receiving pixel-driving power (EVDD) to be driven, a drive IC 220 for receiving first driving power (VDD1) to be driven and providing a data signal to the display panel 210, a controller 230 for controlling the drive IC 220 and receiving second driving power (VDD2) to be driven, and a power unit 240 for maintaining the second driving power (VDD2) within a preset time after a turn-off signal is input.

The organic light-emitting display device 200 may receive an image signal (RGB) from an external device 250 and supply the image signal to the controller 230. The controller 230 may supply a sensing signal (Ssen) to the drive IC 220. The controller 230 may receive panel information containing detected deterioration information from the drive IC 220 according to the sensing signal (Ssen). The controller 230 may calculate a compensation value according to the panel information. The controller 230 may generate a compensated compensation image signal (RGB') based on the compensation value and supply the compensation image signal (RGB') to the drive IC 220. Although only one drive IC 220 is illustrated, the present invention is not limited thereto. The drive IC 220 may be a drive circuit including a plurality of drive ICs.

When the turn-on signal is input, the controller 230 may control the drive IC 220 to operate in the first driving scheme including the sensing period and the display period. When the turn-on signal is input within a preset time after the turn-off signal is input, the controller 230 may control the drive IC 220 to operate in the second driving scheme in which the display period is directly executed. When the display period is directly executed without the sensing period after the turn-on signal is input, the time required for the organic light-emitting display device 200 to enter the display period may become very short. The turn-on/turn-off signal may be input into the power unit 240. The power unit 240 may output the pixel-driving power (EVDD), the first driving power (VDD1), and the second driving power (VDD2) according to the turn-on/turn-off signal, and the controller 230 may receive the second driving power (VDD2) in response to the turn-on signal. When the turn-on signal is input, the controller 230 may operate to control the drive IC 220.

The turn-on/turn-off signal may be transmitted from the external device 250 to the power unit 240. The external device 250 may receive the turn-on signal/turn-off signal, wirelessly transmitted under the control of a remote controller, and transmit the received turn-on/turn-off signal to the power unit 240. Further, the external device 250 may receive the turn-on/turn-off signal from control of a switch and transmit the received turn-on/turn-off signal to the power unit 240. However, the transmission of the turn-on/turn-off signal is not limited thereto.

The power unit 240 may directly turn off the display panel 210 by blocking the pixel-driving power (EVDD) supplied to the display panel 210 in response to the turn-off signal. The display panel 210 consumes a large amount of current, and may reduce power consumption if the display panel 210 is directly turned off. However, the present invention is not limited thereto, and the pixel-driving power (EVDD) may be maintained for a predetermined time after the turn-off signal is input. When the pixel-driving power (EVDD) is maintained for the predetermined time, the controller 230 may transmit black data to the drive IC 220 and cause the display panel 210 to appear black in order to reduce power consumption.

According to an embodiment, the power unit 240 may block the first driving power (VDD1) supplied to the drive IC 220 and the second driving power (VDD2) supplied to the controller 230 after maintaining them for a predetermined time after the turn-off signal is transmitted.

Further, when the turning on/turning off is frequently performed, the power unit 240 may break due to heat and excessive power consumption. However, by maintaining driving power including the first driving power (VDD1) and the second driving power (VDD2) for a predetermined time without immediately interrupting the driving power, the power unit 240 may reduce the number of times of turning on/turning off and thus reduce heat generated in the power unit 240, which reduces breakdown. Further, by displaying an image based on the pre-stored panel information without executing the sensing period when turning on is performed within a short time after turning off, the time during which no image is displayed on the display panel 210 may be reduced.

Figure 2B:
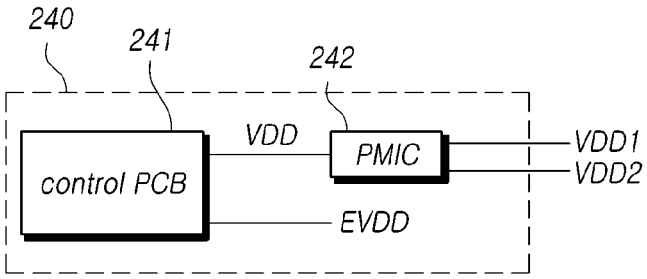
FIG. 2B is a block diagram illustrating an embodiment of a power unit according to the present embodiments.

FIG. 2B is a block diagram illustrating an embodiment of a power unit according to the present embodiments.

Referring to FIG. 2B, the power unit 240 may include a control PCB 241 and a PMIC 242.

The control PCB 241 may receive pixel-driving power (EVDD) and IC-driving power (VDD) from a device. The received pixel-driving power (EVDD) may be output and supplied to the display panel 110 illustrated in FIG. 1. Further, the received IC-driving power (VDD) may be transmitted to the PMIC 242.

The PMIC 242 may supply driving power to ICs adopted by the organic light-emitting display device. The ICs may include the drive IC 120 and the controller 130. Among the driving power output from the PMIC 242, driving power supplied to the drive IC 120 may be referred to as first driving power (VDD1) and driving power supplied to the controller 130 may be referred to as second driving power (VDD2). However, the number of driving powers output from the PMIC 242 is not limited thereto.

The pixel-driving power (EVDD) supplied from the outside to the control PCB 241 may be immediately turned off when the turn-off signal is input. Further, the IC-driving power (VDD) supplied from the outside to the control PCB 241 may be turned off after being maintained for a predetermined time. However, the present invention is not limited thereto, and the pixel-driving power (EVDD) and the IC-driving power (VDD) may be turned off after being maintained for a predetermined time.

Figure 3:
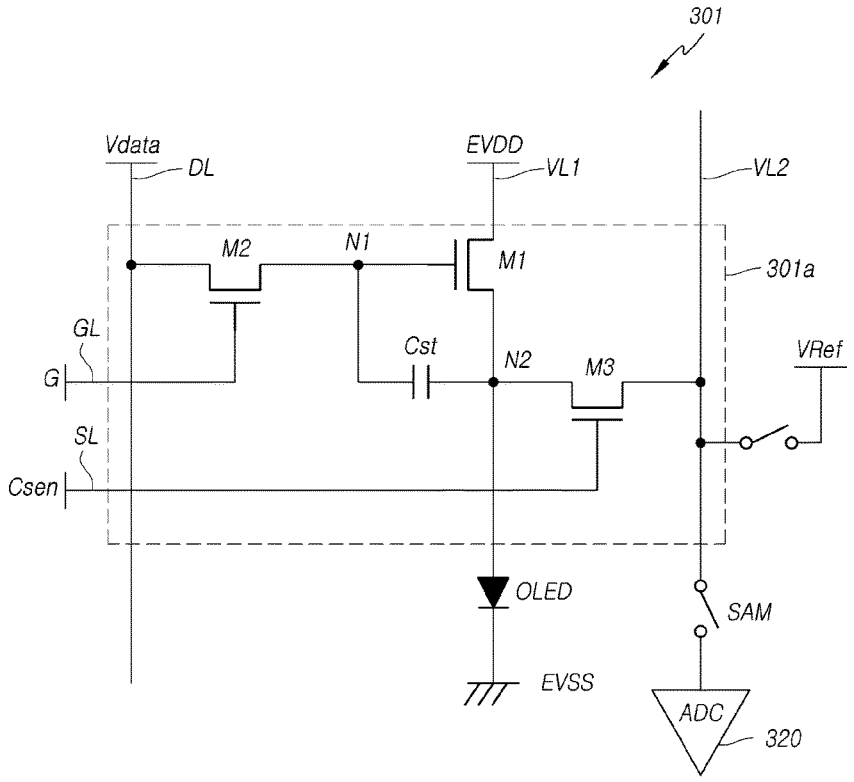
FIG. 3 is a circuit diagram illustrating an embodiment of a pixel adopted by a display panel of the organic light-emitting display device according to the present embodiments.

FIG. 3 is a circuit diagram illustrating an embodiment of a pixel adopted by the display panel illustrated in FIG. 1.

Referring to FIG. 3, a pixel 301 may include an organic light-emitting diode (OLED) and a pixel circuit 301*a*.

The organic light-emitting diode (OLED) may emit light based on flows of driving currents corresponding to a voltage of an anode electrode and a voltage of a cathode electrode. Further, the organic light-emitting diode (OLED) may include an organic film, and the organic film may emit red, green, blue, and/or white light.

The pixel circuit 301*a* may transmit the driving currents to the organic light-emitting diode (OLED). The pixel circuit 301*a* may include a first transistor (M1), a second transistor (M2), a third transistor (M3), and a capacitor (Cst). The first transistor (M1) may be a driving transistor for generating the driving current in accordance with a data signal. The second transistor (M2) and the third transistor (M3) may be switching transistors.

In the first transistor (M1), a first electrode may be connected to a first power line (VL1), a second electrode may be connected to a second node (N2), and a gate electrode may be connected to a first node (N1). The second node (N2) may be connected to the anode electrode of the organic light-emitting diode (OLED). The driving current may flow in a direction from the first electrode to the second electrode in accordance with the voltage transmitted to the first node (N1).

In the second transistor (M2), a first electrode may be connected to a data line (DL), a second electrode may be connected to the first node (N1), and a gate electrode may be connected to a gate line (GL). A data voltage (Vdata) transmitted through a data line (Dm) may be transmitted to the first node (N1) in accordance with a gate signal (G) transmitted through the gate line (GL).

In the third transistor (M3), a first electrode may be connected to a second power line (VL2), a second electrode may be connected to the second node (N2), and a gate electrode may be connected to a sensing control signal line (SL). The third transistor (M3) may transmit a voltage of the second node (N2) to an ADC 320 connected to the second power line (VL2) in accordance with the sensing control signal (Csen) transmitted through the sensing control signal line (SL) as information corresponding to the driving current flowing to the organic light-emitting diode and the driving voltage applied to the organic light-emitting diode. The ADC 320 may be included in the drive IC 120 illustrated in FIG. 1.

The capacitor (Cst) may be disposed between the first node (N1) and the second node (N2) and maintain the voltage of the first node (N1) in accordance with the voltage stored in the capacitor (Cst).

The pixel 301 may receive sensing signals through the data lines (D1, . . . , Dm) during a sensing period and transmit the current and the voltage flowing in the second node (N2) to the ADC 320 through the second power line (VL2) and the switch SAM. The second power line (VL2) is connected to a reference voltage (VRef) through a switch. Further, the data signals are transmitted through the data lines (D1, . . . , Dm) during a display period, and the organic light-emitting diode (OLED) emits light and displays an image in accordance with the driving current flowing in the data signal.

The gate signal (G) and the sensing control signal (Csen) for turning on/turning off the second transistor (M2) and the third transistor (M3) may be the same signal.

The pixel configured as described above may be adopted by the display panel 210 illustrated in FIG. 2A. Further, in the pixel 301, during the sensing period of sensing the characteristic of the display panel 210 illustrated in FIG. 2A, the sensing signal may be applied to one or more data lines of the display panel 210, voltage variation may be generated in one or more data lines and other signal lines (for example, second power lines), and the characteristics of the display panel 210 may be sensed through the generated voltage variation.

Here, it is illustrated that the pixel 301 is used for the display panel 210 illustrated in FIG. 2A, but the present invention is not limited thereto, and the pixel 301 may be used for the display panel 110 illustrated in FIG. 1.

Figure 4:
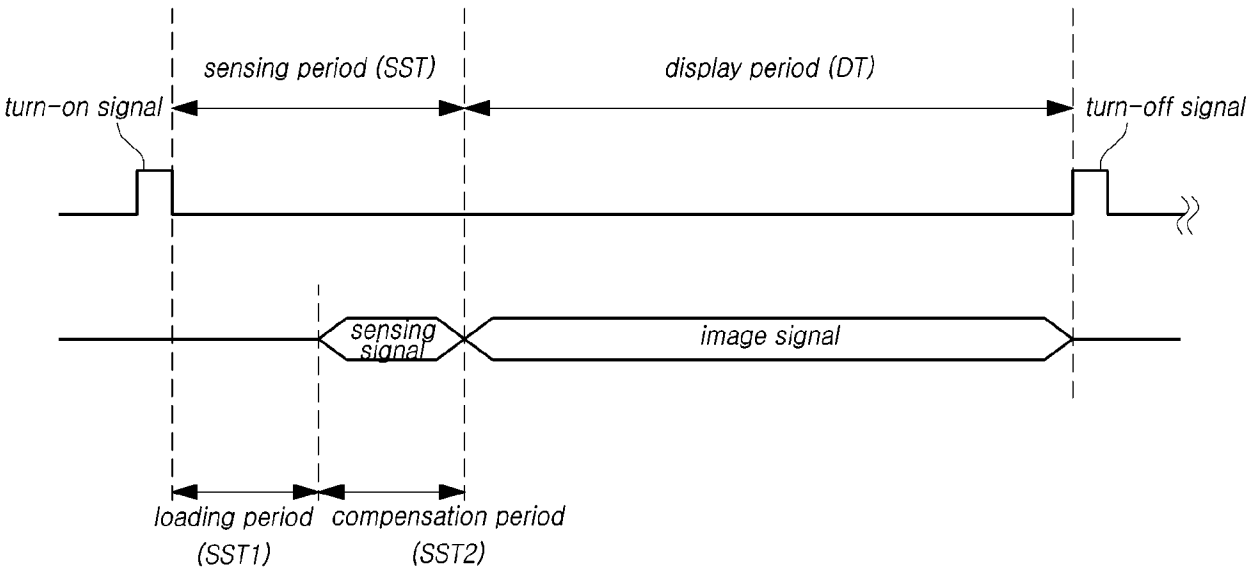
FIG. 4 is a timing diagram illustrating the operation of the organic light-emitting display device according to the present embodiments.

FIG. 4 is a timing diagram illustrating a first embodiment of the operation of the organic light-emitting display device illustrated in FIG. 1.

Referring to FIG. 4, the organic light-emitting display device 100 may operate with a sensing period (SST) and a display period (DT).

The organic light-emitting display device 100 may be turned on. The organic light-emitting display device 100 may be turned on by a turn-on signal. When the organic light-emitting display device 100 is turned on, the sensing period (SST) may be executed. In the sensing period (SST), a sensing signal may be supplied from the drive IC 120 to the pixel 101. When the sensing signal is supplied, each pixel 101 of the display panel 110 may generate a sensing current in accordance with the sensing signal. Panel information containing information about deterioration of a driving transistor and information about deterioration of an organic light-emitting diode may be detected based on the sensing current. Further, a compensation value may be calculated in accordance with the deterioration information. To this end, the sensing period (SST) may include a loading period (SST1) and a compensation period (SST2).

The loading period (SST1) may be a period of receiving an initial characteristic value corresponding to initial panel information, and the compensation period (SST2) may be a period of calculating a compensation value corresponding to the initial characteristic value and the sensing signal. The initial characteristic value may be stored in a memory when manufactured.

Further, when the sensing period (SST) ends, the display period (DT) may be executed. The display period (DT) may be a period of displaying an image on the display panel 110. In the display period (DT), the image signal may be compensated for in accordance with the compensation value generated in the sensing period (SST), and thus a compensation image signal may be generated. Then, the compensation image signal may be transmitted to each pixel, and a driving current corresponding to the compensation image signal may be generated. The organic light-emitting diode may emit light using the generated driving current, and the image may be displayed.

When the organic light-emitting display device 100 driven as described above is turned on, the display period may be executed after the sensing period is executed, and the image corresponding to the compensation image signal may be displayed on the display panel 110. Accordingly, it is possible to prevent image quality degradation due to deterioration. However, when the organic light-emitting display device 100 is turned on, the display period is executed after the sensing period is executed, so that it takes a long time to display the image on the display panel 110 after the turning on.

Due to the above problem such as erroneous operation, even though the user immediately inputs the turn-on signal again when the organic light-emitting display device 100 is turned off by the turn-off signal, it takes a predetermined time to display the image on the display panel 110.

Figure 5:
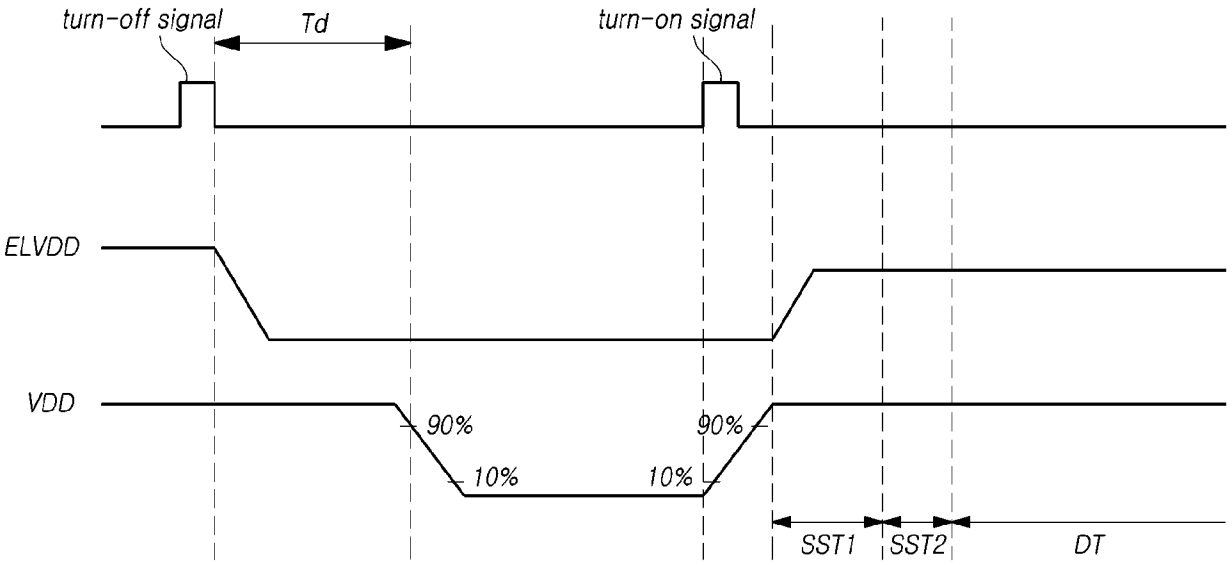
FIG. 5 is a timing diagram illustrating a change in driving power in accordance with a turn-on/turn-off signal in the organic light-emitting display device according to the present embodiments.
Figure 6:
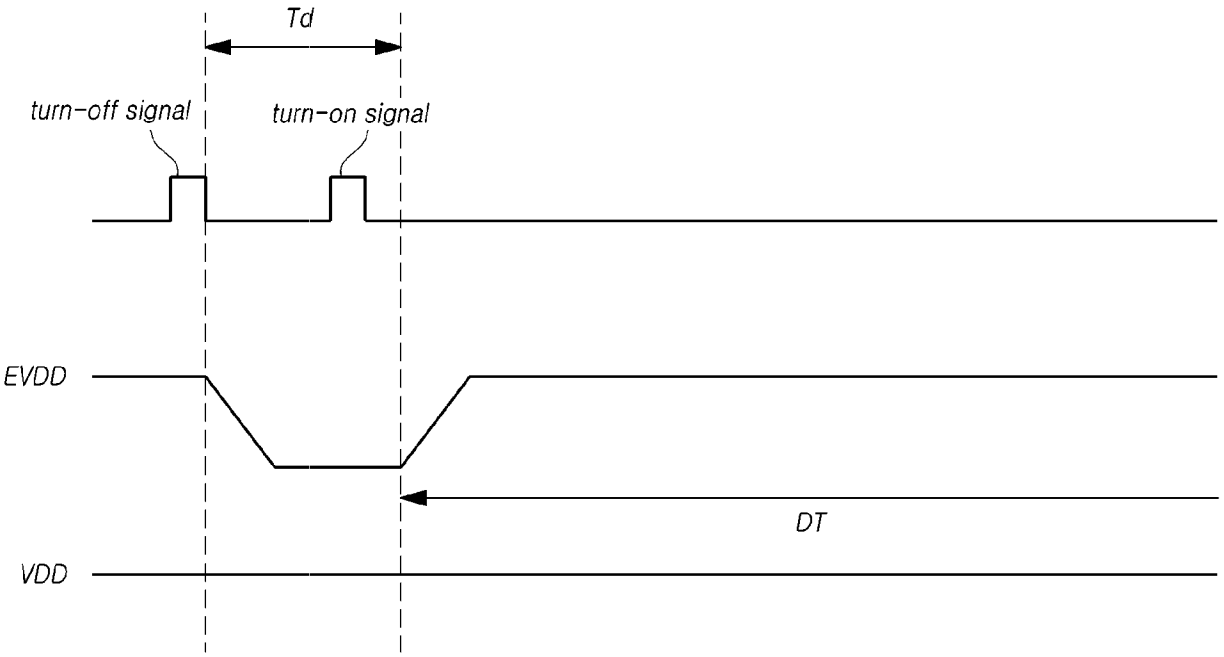
FIG. 6 is a timing diagram illustrating a change in driving power in accordance with a turn-on/turn-off signal in the organic light-emitting display device according to the present embodiments.
Figure 7:
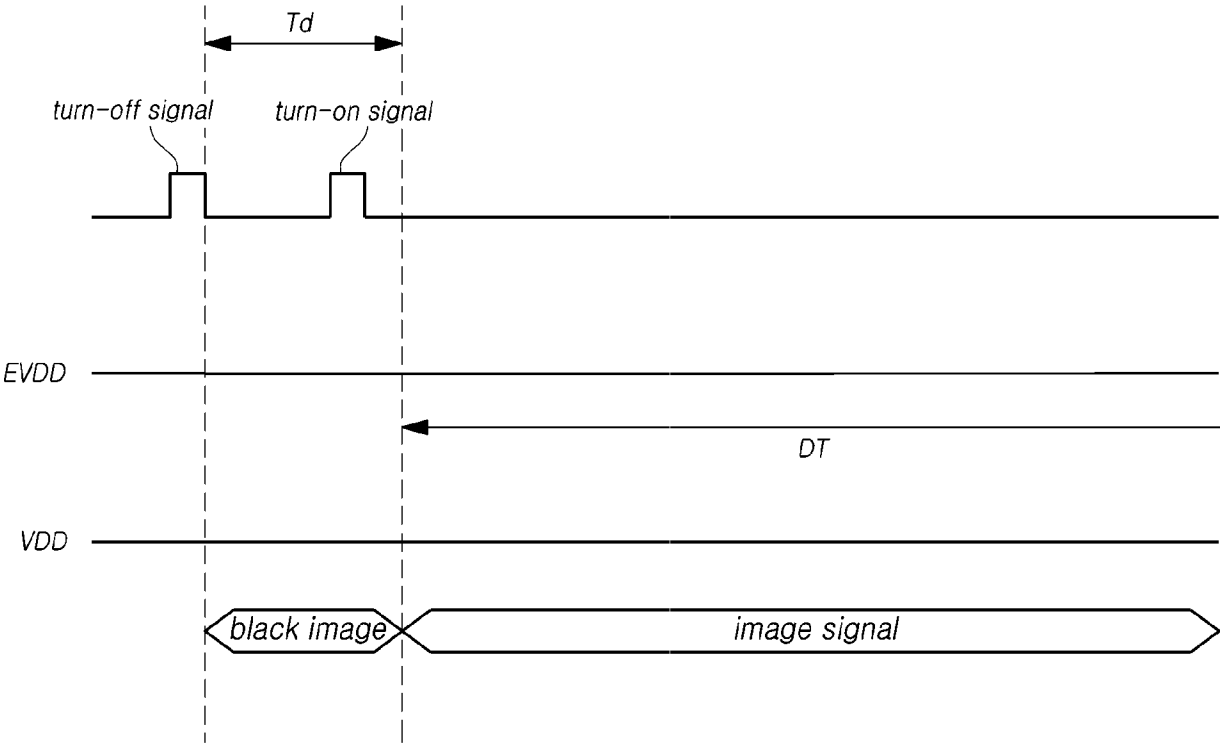
FIG. 7 is a timing diagram illustrating a change in driving power in accordance with a turn-on/turn-off signal in the organic light-emitting display device according to the present embodiments.

FIG. 5 is a timing diagram illustrating a first embodiment in which driving power is changed according to a turn-on/turn-off signal in the organic light-emitting display device illustrated in FIG. 1, and FIG. 6 is a timing diagram illustrating a second embodiment in which driving power is changed according to a turn-on/turn-off signal in the organic light-emitting display device illustrated in FIG. 1. FIG. 7 is a timing diagram illustrating a third embodiment in which driving power is changed according to a turn-on/turn-off signal in the organic light-emitting display device illustrated in FIG. 1.

Referring to FIG. 5, when a turn-off signal is input from an external device, pixel-driving power (EVDD) supplied from the power unit 140 to the display panel 110 is turned off. At this time, a voltage of the pixel-driving power (EVDD) may be lowered with a predetermined slope at a turn-off time by an RC delay.

However, IC-driving power (VDD) is not blocked until a preset time (Td), and thus a preset voltage may be maintained. Since the controller 130 may operate by receiving second driving power corresponding to the IC-driving power (VDD), the driving may not stop until the preset time (Td), during which the IC-driving power (VDD) remains in a high state. Further, although not illustrated, a waveform of second driving power (VDD2) may be the same as that of the IC-driving power (VDD). The preset time may be a fixed time. Further, the preset time (Td) may be a time during which the voltage of the IC-driving power (VDD) is lowered to a preset voltage after the IC-driving power (VDD) is blocked. Here, the preset voltage may be a voltage corresponding to 90% of the voltage of the IC-driving power (VDD) in the high state. However, the present invention is not limited thereto.

When the turn-on signal is input after the preset time has passed, the IC-driving power (VDD) may switch back to the high state. Further, the pixel-driving power (EVDD) may enter the high state after the IC-driving power (VDD) enters the high state. At this time, the controller 130 does not receive the second driving power corresponding to the IC-driving power (VDD) before the turn-on signal is input after the preset time has passed, and thus may be reset. Accordingly, pre-generated panel information may also be reset. Therefore, when the turn-on signal is input after the preset time has passed, the panel information should be generated again through re-execution of the first sensing period (SST1) and the second sensing period (SST2). In the display period (DT), the controller 130 may generate a compensation value based on the generated panel information. The controller 130 may generate a compensation image signal in accordance with the compensation value and display an image on the display panel 110 according to the compensation image signal.

FIG. 6 shows a voltage change of driving power when the user inputs the turn-on signal within the preset time (Td). When the turn-off signal is input, pixel-driving power (EVDD) is blocked at the time point at which the turn-off signal is input, and the voltage thereof may be lowered. At this time, IC-driving power (VDD) may maintain the voltage in the high state for the preset time (Td). The controller 130 receives second driving power (VDD2) corresponding to the IC-driving power (VDD) and thus may not be reset while the voltage of the IC-driving power (VDD) remains in the high state.

Further, since the pixel-driving power (EVDD) is not supplied to the display panel 110, the display panel 110 may not display the image before the turn-on signal is input after the turn-off signal is generated.

When the turn-on signal is input within the preset time (Td), the IC-driving power (VDD) may not be turned off, and thus the voltage thereof may be maintained. Accordingly, the controller 130 may operate without being reset. When the controller 130 is not reset, the panel information is not initialized, and the execution of the first sensing period and the second sensing period is not required. Accordingly, the controller 130 may directly execute the display period (DT), and the display panel 110 may display the image since the pixel-driving power (EVDD) enters the high state.

When the turn-on signal is input within the preset time (Td) although the turn-off signal is input, the controller 130 may directly execute the display period (DT) without executing the first sensing period and the second sensing period, thereby shortening the time spent for displaying the image after the turn-on signal is input.

FIG. 7 illustrates the case in which the pixel-driving power (EVDD) is not immediately turned off when the turn-off signal is input but is maintained for the preset time (Td). In this case, black data may be supplied during the preset time (Td) and the display panel 110 may appear black. Since no image is displayed on the display panel 110 at the time point at which the turn-off signal is input, power consumption may be reduced.

Figure 8:
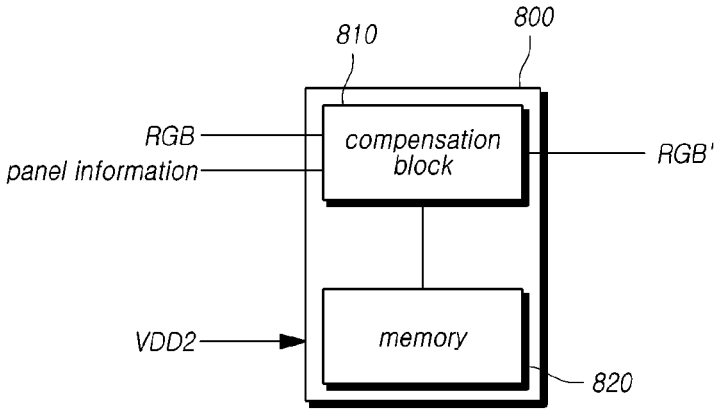
FIG. 8 is a block diagram illustrating an embodiment of the controller according to the present embodiments.
Figure 9:
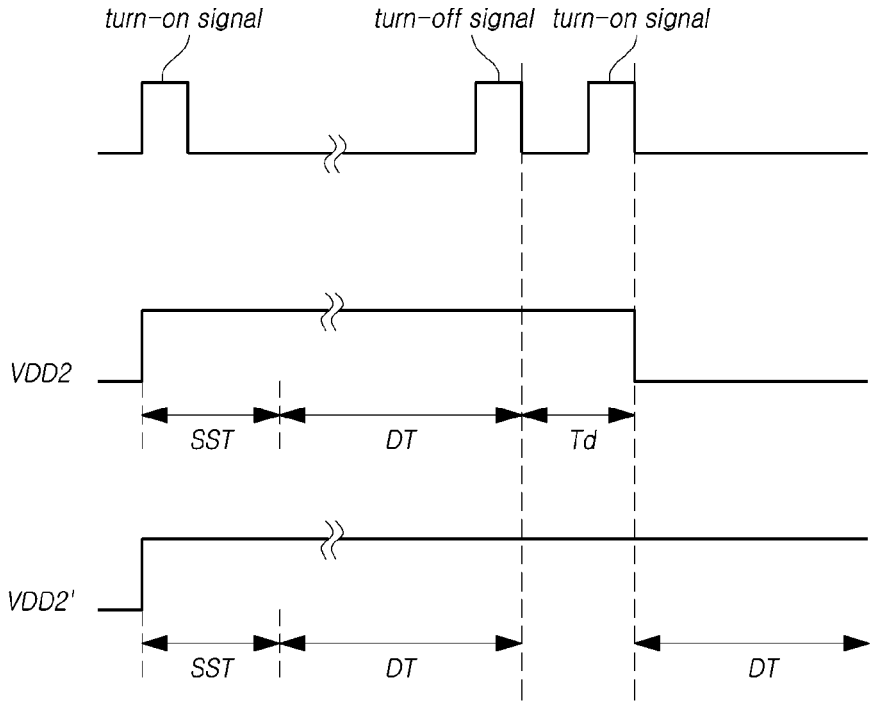
FIG. 9 is a timing diagram illustrating an embodiment of the operation of the controller according to the present embodiments.

FIG. 8 is a block diagram illustrating an embodiment of the controller illustrated in FIG. 1, and FIG. 9 is a timing diagram illustrating an embodiment of the operation of the controller illustrated in FIG. 8.

Referring to FIG. 8, the controller 800 may store a characteristic value of the display panel and may include a memory 820 loaded in accordance with second driving power (VDD2) and a compensation block 810 for receiving the characteristic value of the display panel from the memory 820 and generating a compensation value when the memory 820 is loaded, and the second driving power (VDD2) may be maintained for a preset time after being turned on.

The compensation block 810 may compare the characteristic value pre-stored in the memory 820 with panel information transmitted in accordance with a sensing signal, and calculate the compensation value. The pre-stored characteristic value may be stored in the memory 820. When loaded, the memory 820 may provide the stored characteristic value to the compensation block 810. When the controller 800 receives the second driving power (VDD2), the memory 820 may be loaded. The compensation block 810 may include a sensing period and a display period, operates in one of a first driving scheme, in which, when turned on, a sensing period of sensing characteristics of the display panel is executed, after which a display period of displaying an image on the display panel is executed, and a second driving scheme, in which, when turned on, the display period of displaying the image on the display panel is executed, the compensation block 810 may operate in the second driving scheme when turned on within the preset time after being turned off.

The memory 820 may store the compensation value in the form of a lookup table. Accordingly, the compensation value may be stored in accordance with the sensed and transmitted panel information.

Referring to FIG. 9, when the second driving power (VDD2), generated in response to the turn-on signal, is input, the controller 800 may start the operation. The controller 800 may operate in a first driving scheme including a sensing period (SST) of generating a compensation value in accordance with the characteristic of the display panel 110 illustrated in FIG. 1 when the second driving power (VDD2) is input and a display period (DT) of generating a compensation image signal (RGB') in accordance with the compensation value generated in the sensing period (SST) and displaying an image in accordance with the compensation image signal (RGB') on the display panel 110, and a second driving scheme including the display period (DT) of displaying the image on the display panel 110 in accordance with the pre-generated compensation value when a turn-on signal is input. Here, it is illustrated that the second turn-on signal is generated within a preset time (Td) after a turn-off signal generated, but the first driving scheme corresponds to the case in which the second turn-on signal is not generated after the turn-off signal is generated and the second driving scheme corresponds to the case in which the illustrated second turn-on signal is generated within the preset time (Td) after the turn-off signal is generated.

Second driving power transmitted to the controller 800 in the first driving scheme is represented as VDD2, and second driving power transmitted to the controller 800 in the second driving scheme is represented as VDD2'.

When the controller 800 is turned on and operates in the first driving mode, the second driving power (VDD2) may be supplied in a high state, and the display period (DT) may be executed after the sensing period (SST) is executed for the preset time. The sensing period may include a loading period of loading the memory 820 and a compensation period of calculating a characteristic value read from the loaded memory and a compensation value based on the characteristic value and a sensing result. The compensation period may continue for a long time since a sensing signal should be applied to each horizontal line of the display panel. When the turn-off signal is input, the second driving power (VDD2) remains in the high state for the preset time (Td) and then enters a low state, so that driving of the controller 800 may stop when the preset time (Td) passes.

On the other hand, when the turn-on signal is generated within the preset time (Td) after the turn-off signal is generated, the second driving power (VDD2') may continuously remain in the high state. At this time, since the driving of the controller 800 does not stop, the controller 800 may operate in the second driving mode, and thus the time at which the image signal is displayed may not be delayed. The second driving mode does not need the sensing period, thereby making the time at which the display period is executed earlier.

Figure 10:
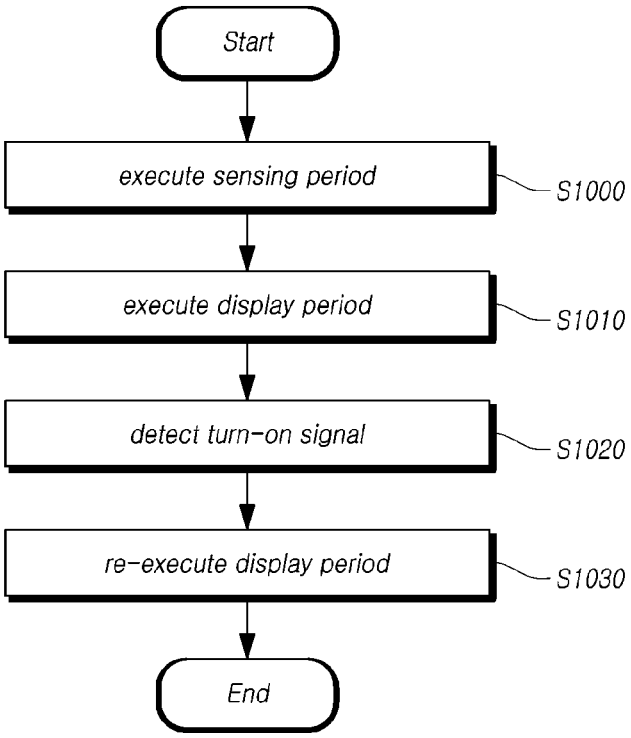
FIG. 10 is a flowchart illustrating an embodiment of a method of driving the organic light-emitting display device according to the present embodiments.

FIG. 10 is a flowchart illustrating an embodiment of a method of driving the organic light-emitting display device illustrated in FIG. 1.

Referring to FIG. 10, when a turn-on signal is input, a sensing period of generating a compensation value corresponding to the characteristics of a display panel may be executed in S1000. The turn-on signal may be transmitted to a power unit for supplying power to the organic light-emitting display device. Further, the turn-on signal may be transmitted through a remote controller or may be transmitted to the power unit in a manner such that the user controls a switch attached to the organic light-emitting display device. However, the present invention is not limited thereto. The turn-on signal may be input into the power unit, and the controller may receive driving power from the power unit.

The sensing period may include a loading time of loading a memory and a compensation period of reading a characteristic value of the display panel stored in the loaded memory and calculating a compensation value based on the acquired panel information based on the read characteristic value of the display panel and a sensing signal.

When the turn-on signal is input, pixel-driving power to be supplied to the display panel, first driving power to be supplied to a drive IC, and second driving power to be supplied to the controller may be generated, and the generated pixel-driving power, first driving power, and second driving power may be supplied to the display panel, the drive IC, and the controller. The second driving power supplied to the controller may be the same as the first driving power. Further, the drive IC may receive the first driving power to generate the second driving power, and supply the second driving power to the controller. However, the present invention is not limited thereto.

Then, the display period of compensating for the image signal transmitted to the display panel in accordance with the compensation value and displaying the image may be executed in S1010. The controller may output a compensation image signal and transmit the compensation image signal to the drive IC. The drive IC may generate a data signal based on the compensation image signal. The display panel may display the image in accordance with the voltage of the data signal.

Further, a turn-on signal may be detected after the turning off in S1020. The second driving power transmitted to the controller may remain in the high state while the turn-on signal is detected. The second driving power may remain in the high state for a preset time after the turn-off signal is generated. Accordingly, the controller receiving the second driving power for the preset time may not be reset, and thus panel information stored in the controller may not be initialized. Here, the second driving power may be one of driving powers supplied from the power unit to the IC. Further, the power unit may receive IC-driving power and generate the second driving power transmitted to the controller.

When the turn-on signal is detected within the preset time after the turn-off signal is input, the display period may be re-executed in accordance with the preset compensation value in S1030. When the turn-on signal is generated within the preset time, the power unit may block the second driving power, and thus the controller may not be reset. Accordingly, panel information may not be initialized, and the sensing period of generating the panel information may not be needed. Therefore, when the turn-on signal is input, the display period may be directly executed, and the organic light-emitting display device may be turned on after the turning off. As a result, it is possible to prevent the time at which an image is displayed from being delayed.

The method of driving the organic light-emitting display device may include a step of detecting a turn-on signal, in which the display panel may receive a black data signal before at least the turn-on signal is detected during a preset time. At this time, even though pixel-driving power supplied to the display panel remains in the high state, the display panel appears black in accordance with the black data, thereby reducing the amount of power consumed by the display panel.

However, when the turn-on signal is detected after the preset time passes, the controller may be reset and panel information may be initialized, so that the display period may be executed after the sensing period is executed again.

Further, the method of driving the organic light-emitting display device may include a step of detecting the turn-on signal in which the preset time may correspond to a period during which a voltage of the second driving power is lowered to a preset voltage.

Accordingly, it is possible to reduce power consumption by preventing frequency generation of turning-on/turning-off of the power unit and decreasing generated heat. Further, it is possible to prevent the power unit from breaking down due to the heat. In addition, a more convenient organic light-emitting display device may be provided to the user through a reduction in the time during which no image is displayed on the display panel when the turn-on signal is input within a short time after being turned off.

It will be apparent to those skilled in the art that various modifications and variations can be made in the organic light-emitting display and method of driving the same of the present disclosure without departing from the technical idea or scope of the disclosure. Thus, it is intended that the present disclosure cover the modifications and variations of this disclosure provided they come within the scope of the appended claims and their equivalents.

What is claimed is:

1. An organic light-emitting display device, comprising:

a display panel configured to receive pixel-driving power for operation thereof;

a drive circuit configured to operate in accordance with IC-driving power and supply a driving signal to the display panel;

a controller configured to operate in one of a first driving scheme, in which, when turned on, a sensing period of sensing information of the display panel is executed and then a display period of displaying an image on the display panel is executed, and a second driving scheme, in which, when turned on, the display period of displaying the image on the display panel is executed; and a power unit configured to transmit the pixel-driving power and the IC-driving power when turned on, wherein the controller includes a compensation block configured to generate a compensation value for compensating for an image signal transmitted to the display panel and a memory configured to store the compensation value and supply the compensation value to the compensation block, wherein when the controller receives the IC-driving power from the power unit, the memory is loaded, and wherein when the power unit receives a turn-off signal, the IC-driving power transmitted from the power unit is not turned off within a preset time.

2. The organic light-emitting display device of claim 1, wherein the controller executes the display period according to a pre-generated compensation value when operating in the second driving scheme.

3. The organic light-emitting display device of claim 1, wherein the pixel-driving power for driving the display panel is maintained for a preset time.

4. The organic light-emitting display device of claim 3, wherein the drive circuit supplies a black data signal to the display panel at least until a turn-on time within the preset time.

5. The organic light-emitting display device of claim 1, wherein the preset time is a time during which a voltage of the IC-driving power is lowered to a preset voltage.

6. An organic light-emitting display device, comprising:

a display panel configured to receive pixel-driving power for operation thereof;

a drive circuit configured to operate in accordance with IC-driving power and provide a data signal to the display panel;

a controller configured to control the drive circuit and operate in accordance with the IC-driving power; and a power unit configured to supply the pixel-driving power and the IC-driving power and maintain the IC-driving power for a preset time after a turn-off signal is input, wherein the controller includes a compensation block configured to generate a compensation value for compensating for an image signal transmitted to the display panel and a memory configured to store the compensation value and supply the compensation value to the compensation block, wherein when the controller receives the IC-driving power from the power unit, the memory is loaded, and wherein when the power unit receives the turn-off signal, the IC-driving power transmitted from the power unit is not turned off within a preset time.

7. The organic light-emitting display device of claim 6, wherein the controller operates with a sensing period and a display period, the sensing period including a loading period of loading the memory and a compensation period of calculating a compensation value based on the loaded sensing period and sensed panel characteristic information, and compensates for an image signal supplied to the display panel by applying the compensation value during the display period.

8. The organic light-emitting display device of claim 6, wherein the pixel-driving power is maintained for at least the preset time.

9. The organic light-emitting display device of claim 8, wherein the drive circuit supplies a black data signal to the display panel until a time point at which at least a turn-on signal is detected within the preset time.

10. A controller, comprising:

a memory configured to store a characteristic value of a display panel and loaded in accordance with IC-driving power; and a compensation block configured to receive the display panel characteristic value from the memory to generate a compensation value when the memory is loaded, wherein the IC-driving power is maintained for a preset time after being turned off, wherein when the IC-driving power is received from a power unit, the memory is loaded, and wherein when a turn-off signal is received, the IC-driving power transmitted from the power unit is not turned off within a preset time.

11. The controller of claim 10, wherein the compensation block includes a sensing period and a display period, operates in one of a first driving scheme, in which, when turned on, a sensing period of sensing characteristics of the display panel is executed, after which a display period of displaying an image on the display panel is executed, and a second driving scheme, in which, when turned on, the display period of displaying the image on the display panel is executed, the compensation block operating in the second driving scheme when turned on within the preset time after being turned off.

12. The controller of claim 11, wherein the controller executes the display period in accordance with a pre-generated compensation value when operating in the second driving scheme.

13. A method of driving an organic light-emitting display device, the method comprising:

executing a sensing period of generating a compensation value corresponding to a characteristic of a display panel by a controller when a turn-on signal is detected;

executing a display period of displaying an image by compensating for an image signal transmitted to the display panel in accordance with the compensation value by the controller; and re-executing the display period in accordance with the compensation value when a turn-on signal is detected within a preset time after being turned off.

14. The method of claim 13, wherein the controller transmits a black data signal to the display panel until a time point at which at least the turn-on signal is detected during the preset time.

15. The method of claim 13, wherein an image is displayed with reference to a preset display panel characteristic in the display period when the display period is re-executed.

* * * * *